US005968884A

United States Patent [19]

Gopalkrishnan et al.

[11] Patent Number: 5,968,884

[45] **Date of Patent: *Oct. 19, 1999**

[54] CONCENTRATED BUILT LIQUID DETERGENTS CONTAINING A BIODEGRADABLE CHELANT

[75] Inventors: Sridhar Gopalkrishnan, Grosse Ile; Kathleen Guiney, Wyandotte, both of Mich.

[73] Assignee: BASF Corporation, Mt. Olive, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,712

[22] Filed: Apr. 7, 1997

[51] Int. Cl.[6] ..... C11D 3/33; C11D 3/37; C11D 11/00; C11D 17/00

[52] U.S. Cl. ..... 510/361; 510/417; 510/418; 510/434; 510/476; 510/480

[58] Field of Search ..... 510/476, 360, 510/361, 434, 480, 533, 417, 418; 252/FOR 241, FOR 245, FOR 198, FOR 166

[56] References Cited

U.S. PATENT DOCUMENTS

| | | | |
|---|---|---|---|
| 5,534,183 | 7/1996 | Gopalkrishnan | 510/434 |
| 5,536,440 | 7/1996 | Gopalkrishnan | 510/417 |
| 5,783,524 | 7/1998 | Greindl et al. | 507/90 |

FOREIGN PATENT DOCUMENTS

| | | |
|---|---|---|
| WO 96/11253 | 4/1994 | European Pat. Off. . |
| 96/26999 | 9/1996 | WIPO . |

OTHER PUBLICATIONS

"New biodegradable complexing agents. Relations between structure and degradability", by Potthoff–Karl, Birgitt, in SOFW J. (1994), 120(2/3), 104, 106–9—see enclosed translation.

*Primary Examiner*—Ardith Hertzog
*Attorney, Agent, or Firm*—Mark A. Frentrup

[57] ABSTRACT

The present invention relates to the formulation of stable, aqueous, concentrated built liquid detergents containing a hydrophilic copolymer and biodegradable chelant.

4 Claims, No Drawings

CONCENTRATED BUILT LIQUID DETERGENTS CONTAINING A BIODEGRADABLE CHELANT

FIELD OF THE INVENTION

The present invention relates to the formulation of stable, aqueous, concentrated built liquid detergents that contain a biodegradable chelant. The invention also relates to a method of preparing stable liquid detergent compositions containing a biodegradable chelant.

BACKGROUND OF THE INVENTION

The incorporation of major amounts of builders in liquid detergent compositions poses a significant formulating challenge since the presence of major amounts of builder inevitably causes the detergent composition to phase separate. Builders such as sodium citrate, citric acid, sodium carbonate, and/or alkali metal silicates can only be incorporated in minor amounts in liquid detergent compositions, such amounts being typically below the concentration levels that would cause separation of the surfactant phase. U.S. Pat. No. 5,536,440 and U.S. Pat. No. 5,534,183 (both assigned to BASF) disclose the use of novel hydrophilic copolymers for stabilizing such concentrated built liquid detergent compositions.

Further, liquid detergent formulators are also concerned with metal ions as they diminish the effectiveness of many detergent formulations. Chelating agents are typically employed to complex the metal ions and thereby significantly improve the performance and efficiency of such formulations. Examples of such chelating agents are the polyphosphates such as potassium diphosphate, sodium tripolyphosphate, aminocarboxylates such as nitrilotriacetate, ethylene diamine tetraacetate, diethylene triamine pentacetate, hydroxycarboxylates such as citric acid, gluconic acid, phosphonates such as amino trimethylene phosphonate and ethylene diamine tetramethylene phosphonate. While the chelating agents listed above have moderate to good complexing power, a number of them have limited utility in commercial cleaning compositions. The major limitations are that chelating agents can cause eutrophication even though they have very good metal complexation properties, while others have poor biodegradability. Another drawback with chelating agents is that incorporation of chelating agents in significant amounts in liquid laundry formulations poses a serious formulating challenge. Chelating agents by virtue of their strong ionic character would typically salt out the surfactant in liquid laundry formulations or cause stability problems in formulating liquid laundry compositions. See, DE 4319935 which discloses the preparation and use of carboxylmethylglycine derivatives as comaplexing agents and WO 96/11253 which discloses a sequestering agent comprising amino acids useful in granular peroxy bleach formulations, and JP 0061637 which discloses carboxymethylamino acids as builders in detergent formulations. Currently, the art is faced with the problem of how to incorporate chelating agents into built liquid detergents.

Applicants have surprisingly discovered that biodegradable chelants can be successfully incorporated into built liquid detergent formulations containing Applicants' hydrophilic copolymer. The resultant built liquid detergent formulation is stable.

SUMMARY OF THE INVENTION

The present invention relates to a stable liquid detergent composition comprising about 5 to 70% of detergent active matter selected from the group consisting of anionic, nonionic, cationic, amphoteric and zwitterionic surfactants, as well as about 1 to 60% of one or more electrolytes. The detergent composition further comprises about 0.1 to 10% of a biodegradable chelant. The detergent composition also has about 0.01 to 5% of at least one hydrophilic copolymer comprised of an unsaturated hydrophilic copolymer copolymerized with a hydrophilic oxyalkylated monomer, selected from Formula I, or Formula II, or both, wherein Formula I is:

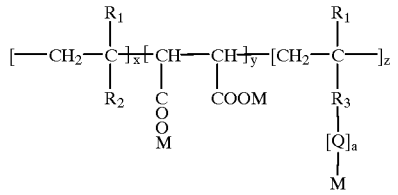

where x, y, z and a are integers; R3, Q, and M comprise the hydrophilic oxyalkylated monomer sidaechain and Q is oxyethylene or a mixture of oxyethylene with C3 –C4 oxyalkylene with the proviso that said sidechain has a solubility of at least 500 g/L in water; M is an alkali metal or hydrogen, and said monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

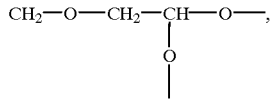

CO—NH—;

and Formula II is:

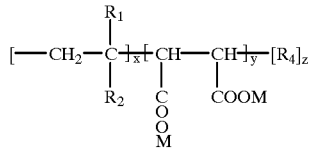

where $R_4$=

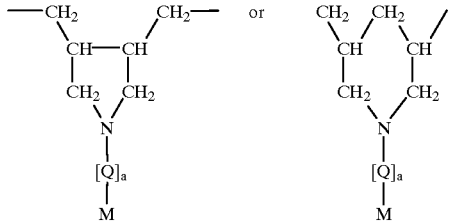

wherein x, y, z and a are integers; Q, and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and said monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

The remainder of the detergent formulation is water. The liquid detergent composition has a phase separation of less than about 2% over a one month period.

Also provided as part of the invention is a method of stabilizing a liquid detergent composition containing a biodegradable chelant which comprises adding thereto about 0.01 to 5% of at least one hydrophilic copolymer having the above formula(s).

DETAILED DESCRIPTION OF THE PRESENT INVENTION

The present invention relates to a stable liquid detergent composition comprising about 5 to 70% of detergent active matter selected from the group consisting of anionic, nonionic, cationic, amphoteric and zwitterionic surfactants, as well as about 1 to 60% of one or more electrolytes. The detergent composition further comprises about 0.1 to 10% of a biodegradable chelant. The detergent composition also has about 0.01 to 5% of at least one hydrophilic copolymer comprised of an unsaturated hydrophilic copolymer copolymerized with a hydrophilic oxyalkylated monomer, selected from Formula I, or Formula II, or both, wherein:

Formula I

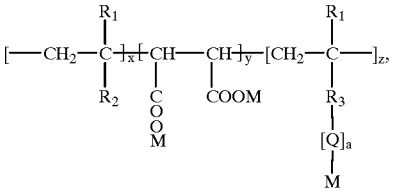

where x, y, z and a are integers; R3, Q, and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and said monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

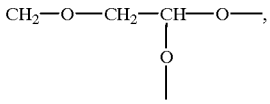

CO—NH—;

and Formula II is:

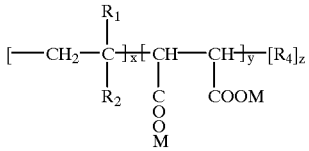

where $R_4$=

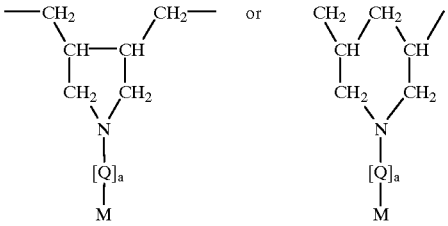

wherein x, y, z and a are integers; Q, and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and said monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

As heretofore stated, the molar ratio (x+y) to z in both Formulas I and II is within the range of about 5:1 to 1,000:1, preferably about 50:1 and 800:1, and more preferably about 100:1 to 200:1. The value of a is within the range of about 1 to 200, more preferably about 1 to 150, and more preferably about 1 to 100.

The total molecular weight of the copolymer will be within the range of about 500 to 500,000, as determined by gel permeation chromatography. It is further desirable that the molecular weight fall within the range of about 1,000 to 100,000, and even more preferably be within the range of about 1,000 to 10,000 WAMW (weight average molecular weight). Molecular weights herein are given in terms of WAMW unless otherwise specified.

The hydrophilic copolymers of the present invention are prepared by copolymerizing two hydrophilic monomers. Specifically, an unsaturated hydrophilic monomer is copolymerized with an oxyalkylated monomer. These monomers may be randomly distributed within the polymer backbone.

The Unsaturated Hydrophilic Monomers

The unsaturated hydrophilic monomer may be selected from the group consisting of acrylic acid, maleic acid, maleic anhydride, methacrylic acid, methacrylate esters and substituted methacrylate esters, vinyl acetate, as well as vinyl acetate copolymerized with said oxyalkylated monomers and hydrolyzed to polyvinyl alcohol, methylvinyl ether, and vinylsulphonate. Preferably, the unsaturated hydrophilic monomer component of the hydrophilic copolymer is acrylic acid. Other useful monomers will include crotonic acid, itaconic acid, as well as vinyl acetic acid.

The Oxyalkylated Monomers

Examples of the oxyalkylated monomer would be compounds that have a polymerizable olefinic moiety with at least one acidic hydrogen and are capable of undergoing addition reaction with alkylene oxide. It is also possible to include monomers with at least one acidic hydrogen that are polymerized first, and then subsequently oxyalkylated to yield the desired product. For example, allyl alcohol is especially preferred since it represents a monofunctional initiator with a polymerizable olefinic moiety having an acidic hydrogen on the oxygen, and is capable of adding to alkylene oxide. Similarly, diallylamine represents another monofunctional initiator with polymerizable olefinic moieties, having an acidic hydrogen on the nitrogen, and is capable of adding to alkylene oxide. Other examples of the oxyalkylated monomer of the copolymer will include reaction products of either acrylic acid, methacrylic acid, maleic acid, or 3-allyloxy-1,2-propanediol with alkylene oxide.

The molecular weight of the oxyalkylated monomer in Formula I or II, according to the various embodiments of the invention will be within the range of about 200 to 30,000, more preferably about 500 to 15,000, and even more preferably about 1,000 to 5,000.

The oxyalkylated moiety represents the side chain of this monomer. The side chain is hydrophilic in nature, that is, the side chain when isolated from its linkage to the backbone carbon atom is completely soluble in water. The monomer unit containing the hydrophilic side chain also has similar solubility characteristics as the side chain. Preferably, the side chain when isolated from its linkage to the backbone will have a solubility in water of at least about 700 grams/liter, and even more preferably about 1,000 grams/liter, or more. Moreover, the entire side chain is hydrophilic in nature by virtue of its extensive solubility in water.

Preparation of the Hydrophilic Copolymers Useful in the Practice of the Present Invention The hydrophilic copolymers of the present invention are prepared by copolymerizing two hydrophilic monomers. Specifically, an unsaturated hydrophilic monomer is copolymerized with an oxyalkylated monomer. These monomers may be randomly distributed within the polymer backbone. The method of preparation of these hydrophilic copolymers is described in U.S. Pat. No. 5, 536,440 and U.S. Pat. No. 5,534,183, incorporated by reference herein. Further, the following non-limiting example illustrates the preparation of the hydrophilic copolymers useful in the practice of the present invention Preparation of Ethylene Oxide Adduct of Allyl Alcohol (I)

To a 1 gallon stainless steel autoclave equipped with steam heat, vacuum and nitrogen pressure capability and agitation, a homogenous mixture of 210.5 grams of allyl alcohol and 23.4 grams of potassium t-butoxide was charged. The vessel was sealed, purged with nitrogen and pressurized to 90 psig with nitrogen. The pressure was then readjusted to 34 psig and the temperature of the vessel was adjusted to 80° C. The first 75 grams of ethylene oxide was charged over a 1 hour period at 75 to 85° C. and <90 psig pressure. The next 125 grams of ethylene oxide was charged over an hour period at 75 to 85° C. and <90 psig. The next 225 grams of ethylene oxide was charged over a 1 hour period at 100 to 110° C. abd <90 psig. The remaining 2140.9 grams of ethylene oxide was added over an 8 hour period at 145 to 155° C. and <90 psig pressure. After all of the ethylene oxide was added, the mixture was reacted at 150° C. for 2 hours and the vessel was vented to 0 psig. The material was stripped at <10 mm Hg and 125° C. for 1 hour then cooled to 50° C. and discharged into an intermediate holding tank for analysis.

To a 2 gallon stainless steel autoclave equipped with steam heat, vacuum, nitrogen pressure capability and agitation, 498.8 grams of the allyl alcohol ethylene oxide intermediate was charged. The vessel was sealed and pressurized to 90 psig with nitrogen and vented to 2 psig. This was repeated two more times. The temperature was adjusted to 145° C. and the pressure was readjusted to 34 psig with nitrogen to the vessel, 2198.3 grams of ethylene oxide was charged at 275 grams per hour. The temperature was maintained at 140 to 150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to a 0 psig and repadded to 34 psig with nitrogen. The addition was continued at 140 to 150° C. and <90 psig pressure. After all of the ethylene oxide was added, the material was held at 145° C. for 1 hour. It was then cooled to 90° C. and 2.9 grams of 85% phosphoric acid was added. The material was mixed for 30 minutes and then vacuum stripped at 100° C. for 1 hour. The batch was cooled to 70° C. and discharged into a holding tank. The product was found to have a number average molecular weight of 4095 g/mol by phthalic anhydride esterification in pyridine.

Copolymerization of (I) with Acrylic Acid

To a 2 liter, four-necked flask equipped with a mechanical stirrer, reflux condenser, thermometer, and outlet for feed lines, were added 301 grams of distilled water and 2.6 grams of 70% phosphorous acid. This solution was heated to 95° C. at which time a monomer blend of 555.4 grams of glacial acrylic acid and 62.8 grams of an allyl alcohol initiated ethoxylate (molecular weight @ 3800), a redox initiator system consisting of 132 grams of a 38% sodium bisulfite solution and 155.2 grams of a 10.9% sodium persulfate solution, are fed into the flask linearly and separately while maintaining the temperature at 95° (+/−3)C. The sodium bisulfite solution and monomer blend feeds are added over 4 hours while the sodium persulfate solution is added over 4.25 hours. The three feeds are added via TEFLON® ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions are complete, the system is cooled to 80° C. At this temperature, 25.3 grams of a 2.4% 2,2'-Azobis (N,N-dimethyleneisobutylramidine)dihydrochloride solution is added to the system over 0.5 hours as a postpolymerizer. When addition is complete the system is reacted for 2 hours at 80° C. After reaction, the system is cooled to 60° C. and the solution pH is adjusted to about 7 with the addition of 658 grams of 50% sodium hydroxide solution. The resultant neutral polymer solution has an approximate solids content of about 40%.

Preparation of the Detergent Compositions of the Present Invention

The hydrophilic copolymer prepared as described hereinbefore is added to detergent compositions, hereinafter described, to impart stability thereto. Stable detergent compositions are those that do not give more than about a 2% phase separation upon storage at room temperature for a period of one month (30 days) from the time of preparation. Preferably, the phase separation is within the range of about 0 to 2%, and even more preferably less than about 1%. The volume fraction of the separated aqueous phase is measured as a function of the total volume of the sample. For example, if the total volume of the sample is 100 mL, then a 2% separation would correspond to 2 mL.

The hydrophilic copolymer will therefore comprise about 0.01 to 5% by weight of the liquid detergent composition. Preferably, the copolymer of the invention will make up about 0.5 to 4% of a typical laundry formulation, even more preferably about 1 to 2%. (Unless otherwise stated, all weight percentages are based upon the weight of the total laundry formulation).

The laundry formulation will contain about 5 to 70% of detergent active matter, more preferably about 15 to 40%, and even more desirably greater than about 25 and up to 35%.

Said detergent active matter may be selected from the group of anionic, nonionic, cationic, amphoteric and zwitterionic surfactants known to the skilled artisan. Examples of these surfactants may be found in McCutcheon, *Detergents and Emulsifiers* 1993, incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol oxyalkylates (preferably oxyethylates) and alcohol oxyethylates. Examples of the alkylphenol oxyalkylates include $C_6$–$C_{18}$ alkyphenols with about 1 to 15 moles of ethylene oxide or propylene oxide or mixtures of both. Examples of alcohol oxyalkylates include $C_6$–$C_{18}$ alcohols with about 1 to 15 moles of ethylene oxide or propylene oxide or mixtures of both. Some of these types of nonionic surfactants are available from BASF Corp. under the trademark PLURAFAC® other types of nonionic surfactants are available from Shell under the trademark NEODOL®. In particular, a $C_{12}$–$C_{15}$ alcohol with an average of 7 moles of ethylene oxide under the trademark NEODOL® 25 to 7 is especially useful in preparing the laundry detergent compositions useful in the invention. Other examples of nonionic surfactants include products made by condensation of ethylene oxide and propylene oxide with ethylene diamine (BASF, TETRONIC® and TETRONIC®R). Also included are condensation products of ethylene oxide and propylene oxide with ethylene glycol and propylene glycol (BASF, PLURONIC® and PLURONIC®R). Other nonionic surface active agents also include alkylpolyglycosides, long chain aliphatic tertiary amine oxides and phosphine oxides.

Typical anionic surfactants used in the detergency art include the synthetically derived water-soluble alkali metal salts of organic sulphates and sulphonates having about 6 to 22 carbon atoms. The commonly used anionic surfactants are sodium alkylbenzene sulphonates, sodium alkylsulphates and sodium alkylether sulphates. Other examples include reaction products of fatty acids with isethionic acid and neutralized with sodium hydroxide, sulphate esters of higher alcohols derived from tallow or coconut oil, and alpha-methylestersulfonates.

Examples of amphoylitic detergents include straight or branched aliphatic derivatives of heterocyclic secondary or tertiary amines. The aliphatic portion of the molecule typically contains about 8 to 20 carbon atoms. Zwitterionic detergents include derivatives of straight or branched aliphatic quatemary ammonium, phosphonium or sulfonium compounds.

The laundry detergent formulation will also contain one or more electrolytes. Electrolytes defined herein are any ionic water-soluble material. The presence of the electrolyte is often required to bring about the structuring of the detergent active material, although lamellar dispersions are reported to be formed with detergent active material alone in the absence of a suitable electrolyte. Electrolytes typically comprise from about 1 to 60% by weight, and more preferably about 25 to 35% of a laundry detergent formulation.

Examples of suitable electrolytes include compounds capable of providing sufficient ionic strength to the aqueous detergent composition. These compounds would include alkali metal salts of citric acid, alkali metal carbonates, and alkali metal hydroxides. Of these, sodium citrate, sodium carbonate and sodium hydroxide are preferred. Potassium salts can also be incorporated to promote better solubility. Other examples of suitable electrolytes will include the phosphate salts such as sodium or potassium tripolyphosphate, and alkali metal silicates.

In many cases the electrolyte utilized will also serve as the builder for enhancing detergency. The builder material sequesters the free calcium or magnesium ions in water and promote better detergency. Additional benefits provided by the builder are increased alkalinity and soil suspending properties. With the near phase-out of phosphate in household laundry detergents, the most commonly used non-phosphate builders are the alkali metal citrates, carbonates, bicarbonates and silicates. All of these compounds are water-soluble. Water-insoluble builders which remove hardness ions from water by an ion-exchange mechanism are the crystalline or amorphous aluminosilicates referred to as zeolites. Mixtures of electrolytes or builders can also be employed. Generally, the amount of electrolyte used in laundry detergent compositions according to the invention will be well above the solubility limit of the electrolyte. Thus, it is possible to have undissolved electrolyte which remains suspended in the liquid matrix. Secondary builders such as the alkali metals of ethylene diamine tetraacetic acid, nitrilotriacetic acid can also be utilized in the laundry formulations of the invention. Other secondary builders known to those skilled in the art may also be utilized.

The laundry detergent formulations of the present invention may also contain additional ingredients such as enzymes, anti-redeposition agents, optical brighteners, as well as dyes and perfumes known to those skilled in the art. Other optional ingredients may include fabric softeners, foam suppressants, and oxygen or chlorine releasing bleaching agents.

Finally, the laundry detergent formulations of the present invention will also contain a biodegradable chelating agent. Preferably the biodegradable chelating agent is either methylglycine-N-N-diacetic acid ("MGDA") or its alkali metal salt or ethylglycine-N-N-diacetic acid or its alkali metal salt. Most preferably, the biodegradable chelating agent is methylglycine-N-N-diacetic acid or its sodium salt. Said biodegradable chelants are preferably present at a level of 0.1 to 10%, more preferably at a level of 3 to 7% and most preferably at a level of 4 to 5%.

EXAMPLES

The following examples will serve to demonstrate the stability of the liquid detergent compositions containing the biodegradable chelant. These examples should not be construed as limiting the scope of the invention.

The examples describe the aqueous liquid detergent compositions of this invention which are stable. The numbers in each column refer to the active weight percentage of each component in the detergent formulation. The stability of the biodegradable chelant of this invention was first investigated in commercially available liquid detergents. The results from these tests are shown in Example-1. In each commercial liquid detergent, physical instability was observed immediately after preparation, when the biodegradable chelant was added to the liquid detergent. In the case of Tide®), physical instability was not observed immediately. However, the composition destabilized over prolonged storage.

Example-1

| Commercial Liquid Detergent | % Chelant | Stability |
|---|---|---|
| Tide ® | 2% MGDA | Unstable |
| All ® | 2% MGDA | Unstable |
| Wisk ® | 2% MGDA | Unstable |
| Fab ® | 2% MGDA | Unstable |
| Purex ® | 2% MGDA | Unstable |

Example-2 illustrates the present invention: a stable, concentrated built liquid detergent composition containing substantial amounts of a biodegradable chelant, e.g. Methylglycine-N-N-Diacetic acid, Sodium Salt, ("MGDA"), and the hydrophilic copolymer as described herein as a stabilizer. This detergent formulation was stable when stored at 25° C. for over two months and also showed excellent stability with 0% phase separation, when stored at 45° C. for over a month.

Example-2

| Ingredient | % Active |
|---|---|
| Sodium LAS | 25 |
| Nonionic Surfactant | 7 |
| Sodium Citrate Dihydrate | 4 |
| Sodium Carbonate | 6 |
| Methylglycine-N—N-Diacetic acid, Sodium Salt | 4 |
| Zeolite A | 9 |
| Water | Balance |
| Viscosity | 1120 cps |
| pH @ 25° C. | 10.9 |
| Hydrophilic Polymer (Formula I) | 1% |

The nonionic surfactant used in the formulations shown in the Examples is NEODOL® 25-7, a product of Shell. The linear alkylbenzene sulfonic acid, sodium salt (LAS) was obtained from Vista under the name Vista C-560 slurry. The zeolite was "ZEOLITE A", also known as VALFOR®100, available from the PQ Corporation of Valley Forge, Pa. Sodium carbonate was obtained from the FMC Corporation under the name FMC Grade 100. The sodium citrate dihydrate was obtained from Haarman & Reimer. Unless otherwise indicated, the polymer used in the formulations was a copolymer of acrylic acid with an oxyethylated allyl alcohol according to Formula I. The ratio of acrylic acid to oxyethylated allyl alcohol was about 93:7 by weight, while the molar ratio was about 116:1. The molecular weight of the oxyethylated monomer was about 700; $R_1$=H, $R_2$=COOM, $R_3$=$CH_2$—O, Q is ethylene oxide and y=0.

While the invention has been described in each of its various embodiments, it is to be expected that certain modifications thereto may occur to those skilled in the art without departing from the true spirit and scope of the invention as set forth in the specification and the accompanying claims.

We claim:

1. A stable built liquid detergent composition comprising by weight:

a. about 5 to 70% of detergent active matter selected from the group consisting of anionic, nonionic, cationic, amphoteric and zwitterionic surfactants;

b. 1 to 60% of one or more electrolytes;

c. 3 to 7% of a biodegradable chelant selected from the group consisting of methylglycine-N-N-diacetic acid (MGDA) or its alkali metal salt, ethylglycine-N-N-diacetic acid or its alkali metal salt, and mixtures thereof; and d. 0.01 to 5% of at least one hydrophilic copolymer comprised of an unsaturated hydrophilic copolymer copolymerized with a hydrophilic oxyalkylated monomer, wherein said hydrophilic copolymer is Formula I or Formula II or both, wherein Formula I is:

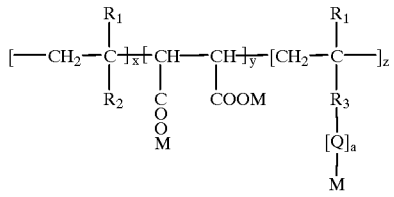

where x, y, z and a are integers; R3, Q and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and the monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

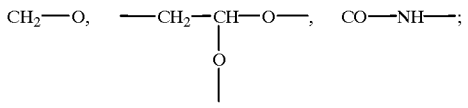

and Formula II is:

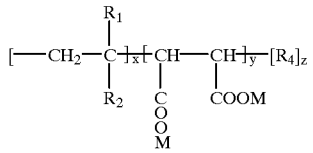

where $R_4$=

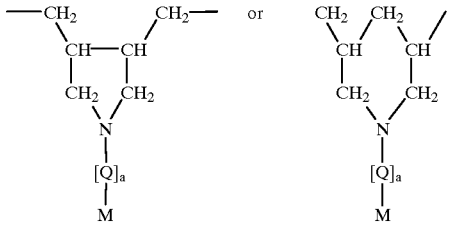

wherein x, y, z and a are integers; Q and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and the monomer units are in random order; (x+y):z is from 5:1 to 1,000:1, x and z cannot be 0 and y can be zero or equal to any value of x; wherein further, each $R_1$=H or $CH_3$; and $R_2$=COOM, $OCH_3$, $SO_3M$, O—CO—$CH_3$, CO—$NH_2$.

2. The composition according to claim 1, wherein in Formula I, $R_1$=H; $R_2$=COOM;

$R_3$=$CH_2$—O; Q is oxyethylene; and y=0.

3. A method of stabilizing a liquid detergent containing a biodegradable chelant selected from the group consisting of methylglycine-N-N-diacetic acid (MGDA) or its alkali metal salt or ethylglycine-N-N-diacetic acid or its alkali metal salt and mixtures thereof, into a built liquid detergent composition comprising adding to said liquid detergent composition 0.01 to 5% by weight of at least one hydrophilic copolymer comprised of an unsaturated hydrophilic copolymer copolymerized with a hydrophilic oxyalkylated monomer, wherein said hydrophilic copolymer is Formula I or Formula II or both, wherein Formula I is:

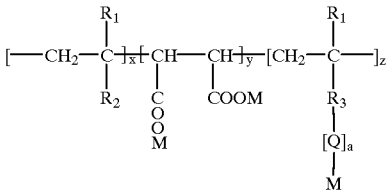

where x, y, z and a are integers; R3, Q, and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and the monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$;

$R_3$=$CH_2$—O, $CH_2$—N—, COO—, —O—,

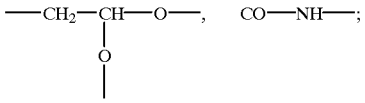

and Formula II is:

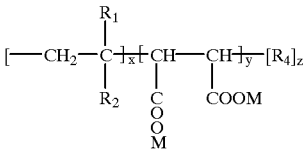

where $R_4$=

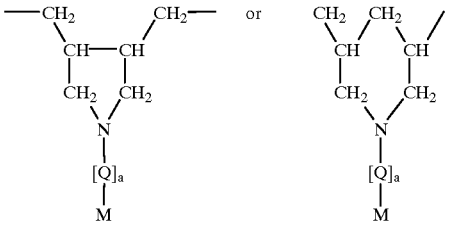

wherein x, y, z and a are integers; Q and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal or hydrogen, and the monomer units are in random order; (x+y):z is from 5:1 to 1,000:1, x and z cannot be 0 and y can be zero or equal to any value of x; wherein further, each $R_1$=H or $CH_3$;

$R_2$=COOM, $OCH_3$, $SO_3M$, O—CO—$CH_3$, CO—$NH_2$.

4. The method according to claim 3, wherein in Formula I, $R_1$=H;

$R_2$=COOM;

$R_3$=$CH_2$—O;

Q is oxyethylene; and y=0.

* * * * *